US006886260B1

(12) United States Patent
Lee

(10) Patent No.: US 6,886,260 B1
(45) Date of Patent: May 3, 2005

(54) ELECTROMOTIVE CAN OPENER

(76) Inventor: Hui Ling Lee, 235 Chung-Ho Box 8-24, Taipei (TW)

( * ) Notice: Subject to any disclaimer, the term of this patent is extended or adjusted under 35 U.S.C. 154(b) by 0 days.

(21) Appl. No.: 10/705,507

(22) Filed: Nov. 12, 2003

(51) Int. Cl.[7] ..... B67B 7/46
(52) U.S. Cl. ..... 30/421; 30/423
(58) Field of Search ..... 30/417, 421, 423, 30/433, 434

(56) References Cited

U.S. PATENT DOCUMENTS 4,561,182 A * 12/1985 Yamamoto et al. ..... 30/433
4,622,749 A * 11/1986 Inagaki ..... 30/421
4,995,164 A * 2/1991 Borger et al. ..... 30/423
6,374,502 B1 * 4/2002 Holcomb et al. ..... 30/417
6,510,613 B1 * 1/2003 Wall ..... 30/410

* cited by examiner

*Primary Examiner*—Hwei-Siu Payer

(57) ABSTRACT

An electromotive can opener comprises a body. The body is formed by a first half and a second half. A motor, a touch switch for actuating the motor, a high twisting gear set, and a cutter handle are assembled to the body. In the high twisting gear set, a plurality of following gears and driving gear are engaged one by one and then is engaged to a driven shaft. The driven shaft is assembled with a driving gear. A knife protrudes out of a cutter handle. In operation, the knife cuts into the can and the touch switch is pressed by the cutter handle to actuate the motor and the shaft is driven. The can is driven to rotate to be cut along the periphery by the knife; and high twisting gear set formed by the plurality of gears provides a high twisting force for securing the can firmly.

2 Claims, 4 Drawing Sheets

ELECTROMOTIVE CAN OPENER

FIELD OF THE INVENTION

The present invention relates to can openers, and particular to an electromotive can opener which is operated electrically so that the user can open a can easily with only a small force by using the electromotive can opener.

BACKGROUND OF THE INVENTION

In the prior art, a can opener is operated manually, namely, an opener with a knife is held by the hand. The knife is cut into the can body firstly and then the knife moves along the periphery of the can body so as to open the can. However, the prior art openers need a larger force for operating it and it is possible that the knife will slide out from the can body. The operation is uneasy and inconvenient.

SUMMARY OF THE INVENTION

Accordingly, the primary object of the present invention is to provide an electromotive can opener which comprises a body. The body is formed by a first half and a second half. A motor, a touch switch for actuating the motor, a high twisting gear set, and a cutter handle are assembled to the body. In the high twisting gear set, a plurality of following gears and driving gear are engaged one by one and then is engaged to a driven shaft. The driven shaft is assembled with a driving gear. A knife protrudes out of a cutter handle. In operation, the knife cuts into the can and the touch switch is pressed by the cutter handle to actuate the motor and the shaft is driven. The can is driven to rotate to be cut along the periphery by the knife; and high twisting gear set formed by the plurality of gears provides a high twisting force for securing the can firmly.

The various objects and advantages of the present invention will be more readily understood from the following detailed description when read in conjunction with the appended drawing.

DETAILED DESCRIPTION OF THE INVENTION

Figure 1:
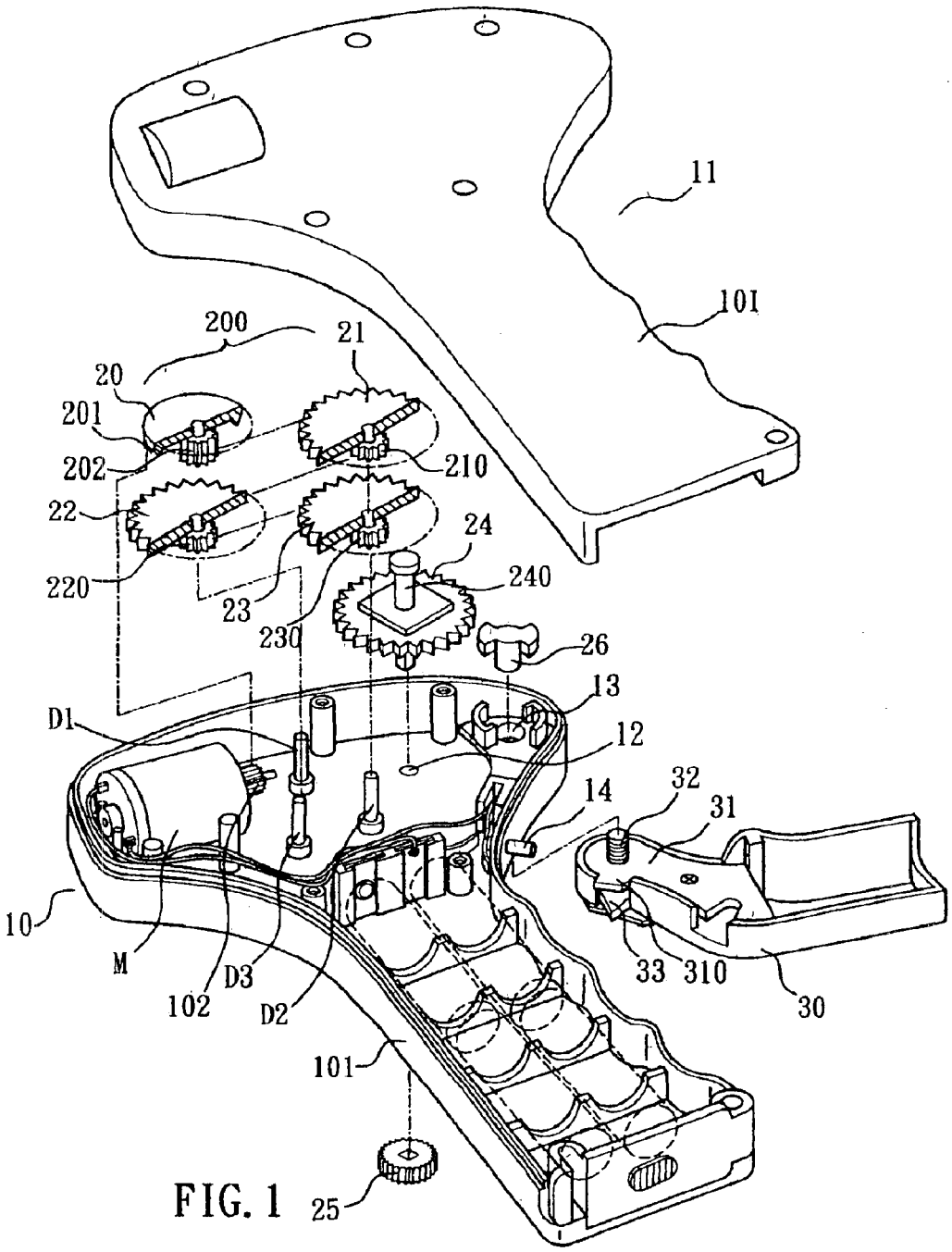
FIG. 1 is an exploded perspective view of the present invention.
Figure 2:
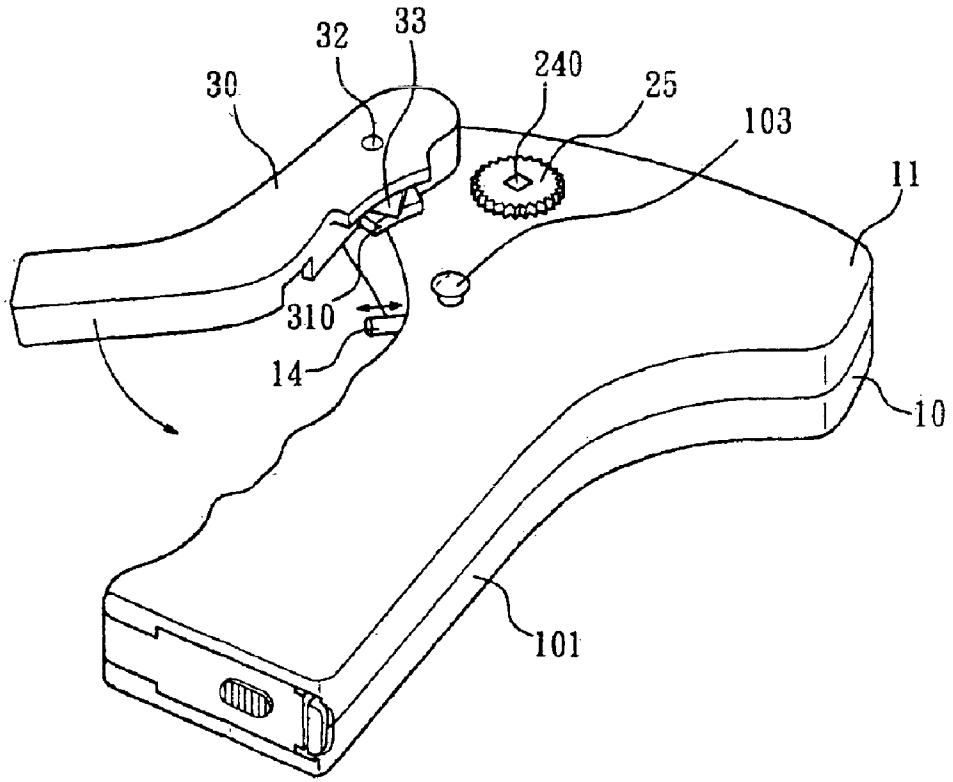
FIG. 2 is an assembled perspective view of the present invention.
Figure 3:
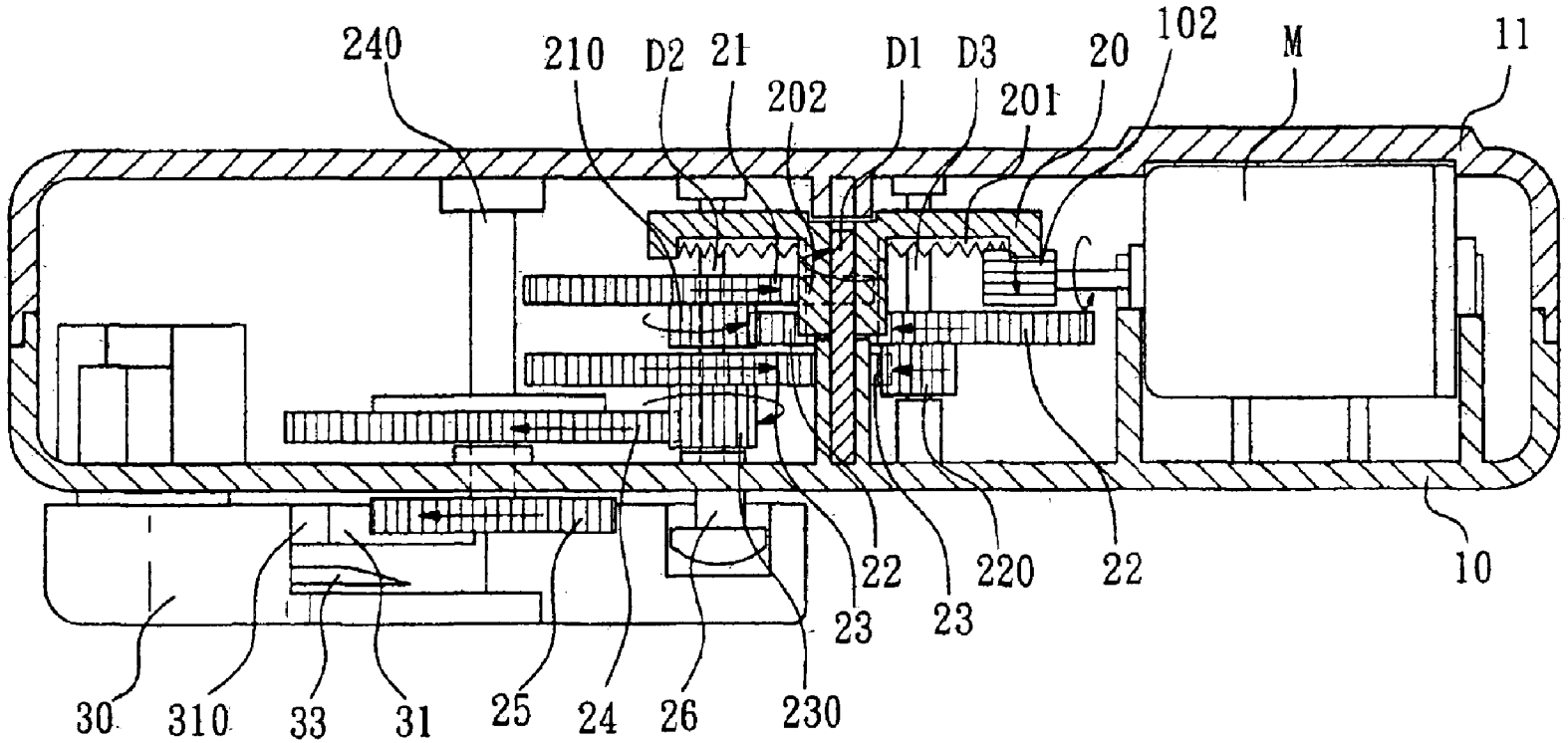
FIG. 3 is a schematic view showing the assembly and operation of the high twisting gear set of the present invention.

In order-that those skilled in the art can further understand the present invention, a description will be described in the following in details. However, these descriptions and the appended drawings are only used to cause those skilled in the art to understand the objects, features, and characteristics of the present invention, but not to be used to confine the scope and spirit of the present invention defined in the appended claims.

With reference to FIGS. 1, 2, 3 and 4, the electromotive can opener of the present invention includes a body which is formed by a first half 10 and a second half 11. A motor M, a touch switch 14 for actuating the motor, a high twisting gear set 200, and a cutter handle 30 are assembled to the body.

The body formed by the first half 10 and second half 11 has a body handle 101. The body handle 101 is formed with a space for receiving a battery set (not shown) for enabling the motor M. The first half 10 has a via hole 12, an axial hole 13, and a plurality of posts 103 for confining a can 40.

The high twisting gear set 200 is installed with a disk gear 20, a first following gear 21, a second following gear 22, a third driving gear 23, a fourth driving gear 24, and a driving gear 25. A lower periphery of the disk gear 20 has a round gear 201 which is engaged to the dynamic gear 102 of the motor M. The disk gear 20 is installed with and movable with a main driven gear 202 which is engaged to the first following gear 21. The first following gear 21 is installed with and movable with a first driven gear 210 and is engaged to the second following gear 22. The second following gear 22 is installed with and movable with a second driven ge ar 220 and is engaged to the third following gear 23. The third following gear 23 is installed with and movable with a third driven gear 230 and is engaged to the fourth following gear 24. The fourth following gear 24 is installed with and movable with a driven shaft 240. The driven shaft 240 passes through the via hole 12 of the first half 10 and then is assembled with the driving gear 25. By above structure, the motor M can drive the driving gear 25.

The cutter handle 30 has one end having a shaft 32. By the shaft 32 and a stud 26, the cutter handle 30 is pivotally installed to the axial hole 13 of the first half 10. A metal enhancing plate 31 and a knife 33 are installed in the cutter handle 30. The knife 33 protrudes out of the cutter handle 30. The metal enhancing plate 31 has a resisting protrusion 310 at a position corresponding to the knife 33. When a can is opened, the cutter handle 30 will cause the knife 33 to cut the can body 40. The resisting protrusion 310 of the metal enhancing plate 31 resists against the can body 40 for equilibrium. Furthermore, when the cutter handle 30 cuts the can body 40, the resisting protrusion 310 resists against the touch switch 14 so as to actuate the motor M.

Figure 4:
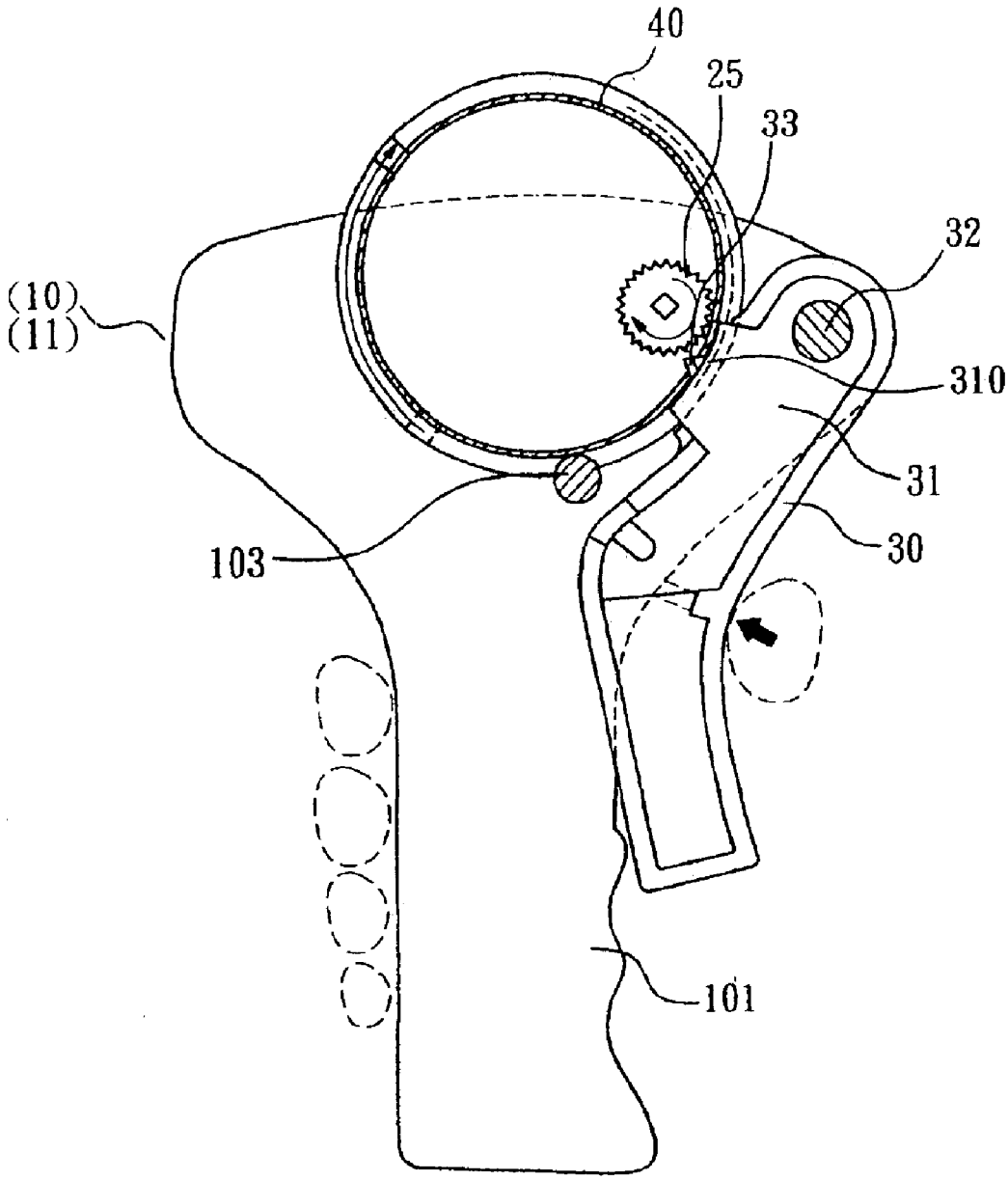
FIG. 4 is a schematic view showing the operation of the present invention.

In the present invention, as shown in FIG. 4, one face of the driving gear 24 faces to the can body 40, and a mouth of the can body 40 is engaged to be between the driving gear 25, the post 103 and the knife 33. Then the cutter handle 30 is held and the mouth of the can body 40 is also tightly held. Then the knife 33 will cut the edge of the can body 40. The driving gear 25 will clip the periphery of the can body 40. The auxiliary resisting post 103 and the resisting protrusion 310 of the metal enhancing plate 31 resists against the outer periphery of the can body 40 for confining the can body 40.

From above description, at the time the cutter handle 30 clips and pressing the can body 40, the touch switch 14 is pressed so that the motor M is actuated. Through the dynamic gear 102, the disk gear 20 of the high twisting gear set 200, the main driven gear 202, each driven gears, and following gears, the driven gear 25 rotates. The driven gear 25 is engaged to the can body 40 to drive the can body 40 to rotate so that the can body 40 is cut by the knife 33. Thus, the can body 40 is opened.

Thereby, the open of the can is performed easily. Power is from the battery set.

In the present invention, the high twisting gear set from the disk gear 20, following gears 21, 22, 23 and 14, and driven gears 210, 220, 230 and 240, thus the high twisting gear set generates a high twisting force. Thereby, the gears will not disengage or slide out.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. An electromotive can opener having a body which is formed by a first half and a second half; and a motor, a touch switch for actuating the motor, a high twisting gear set, and a cutter handle have assembled to the body; wherein the body formed by the first half and second half has a body handle; the body handle is formed with a space for receiving a battery set for enabling the motor; the first half has a via hole, an axial hole, and a plurality of posts for confining a can;

the high twisting gear set is installed with a disk gear, a first following gear, a second following gear, a third driving gear, a fourth driving gear, and a driving gear; a lower periphery of the disk gear has a round gear which is engaged to a dynamic gear of the motor; the disk gear is installed with and movable with a main driven gear which is engaged to the first following gear; the first following gear is installed with and movable with a first driven gear and is engaged to the second following gear; the second following gear is installed with and movable with a second driven gear and is engaged to a third following gear; the third following gear is installed with and movable with a third driven gear and is engaged to a fourth following gear; the fourth following gear is installed with and movable with a driven shaft; the driven shaft passes through the via hole of the first half and then is assembled with the driving gear; by above structure, the motor can drive the driving gear;

the cutter handle has one end having a shaft; by the shaft of the cutter handle and a stud, the cutter handle is pivotally installed to the axial hole of the first half; a knife protrudes out of the cutter handle; when a can is to be opened, the knife will cut into the can and the touch switch is pressed by the cutter handle to actuate the motor;

wherein the can is clipped and thus rotates so as to be cut by the knife; and the high twisting gear set forming the plurality of gears provides a high twisting force for securing the can firmly.

2. The electromotive can opener as claimed in claim 1, wherein the cutter handle has a metal enhancing plate; the metal enhancing plate has a resisting protrusion at a position corresponding to the knife; when the knife cut into the can, the resisting protrusion will press the touch switch so as to actuate the motor.

* * * * *